US005369479A

United States Patent [19]

Tsuyuki

[11] Patent Number: 5,369,479

[45] Date of Patent: Nov. 29, 1994

[54] IMAGE FORMING ASSEMBLY AND IMAGE RECORDING APPARATUS HAVING SEPARABLE IMAGE FORMATION UNITS WITH COMPLEMENTARY HANDLES THEREFOR

[75] Inventor: Yasuhiro Tsuyuki, Tokyo, Japan

[73] Assignees: Casio Electronics Manufacturing Co., Ltd., Tokyo, Japan; Casio Computer Co., Ltd., Tokyo, Japan

[21] Appl. No.: 935,992

[22] Filed: Aug. 27, 1992

[30] Foreign Application Priority Data

Sep. 25, 1991 [JP] Japan ..... 3-077476[U]

[51] Int. Cl.[5] ..... G03G 15/06

[52] U.S. Cl. ..... 355/260; 355/200; 355/210

[58] Field of Search ..... 355/245, 210, 200, 260, 355/211, 296

[56] References Cited

U.S. PATENT DOCUMENTS

| | | | |
|---|---|---|---|
| 4,540,268 | 9/1985 | Toyono et al. | 355/210 |
| 4,598,993 | 7/1986 | Mizutani et al. | 355/211 |
| 4,678,318 | 7/1987 | Bisaiji | 355/296 |
| 4,757,344 | 7/1988 | Idenawa et al. | 355/260 |
| 4,943,828 | 7/1990 | Manabe et al. | 355/200 |
| 4,987,446 | 1/1991 | Mochimaru et al. | 355/200 |
| 5,017,962 | 5/1991 | Tsuji et al. | 355/210 |
| 5,051,778 | 9/1991 | Watanabe et al. | 355/200 |
| 5,119,137 | 6/1992 | Kataga | 355/210 X |
| 5,140,369 | 8/1992 | Haneda et al. | 355/210 |
| 5,160,964 | 11/1992 | Takahashi et al. | 355/200 |
| 5,182,601 | 1/1993 | Hodoshima et al. | 355/245 X |
| 5,204,713 | 4/1993 | Yamamura | 355/210 |

FOREIGN PATENT DOCUMENTS

| | | |
|---|---|---|
| 61-176556 | 11/1986 | Japan . |
| 1-36944 | 9/1989 | Japan . |
| 1-172051 | 12/1989 | Japan . |

*Primary Examiner*—A. T. Grimley
*Assistant Examiner*—Sandra L. Brasé
*Attorney, Agent, or Firm*—Nixon & Vanderhye

[57] ABSTRACT

An image forming assembly includes a first unit having a photosensitive drum as an image carrier and a second unit being independent of the first unit and having a developing device as one of image formation relating devices for taking part in an image formation on the photosensitive drum, is removably fitted in a housing of an image forming apparatus at its predetermined position along a paper feeding path in the housing and functions as a main portion for forming an image on a paper sheet being fed along the paper feeding path. The first and second units are adjacent to each other at their predetermined positions along the paper feeding path, and are provided with handles being adjacent to each other when the first and second units are adjacent to each other at their predetermined positions within the housing. The two handles can be held simultaneously by a single hand of an operator when the first and second units are adjacent to each other at their predetermined positions within the housing, so that the first and second units can be simultaneously fitted to or simultaneously removed from the predetermined positions within the housing.

22 Claims, 3 Drawing Sheets

FIG. 2A
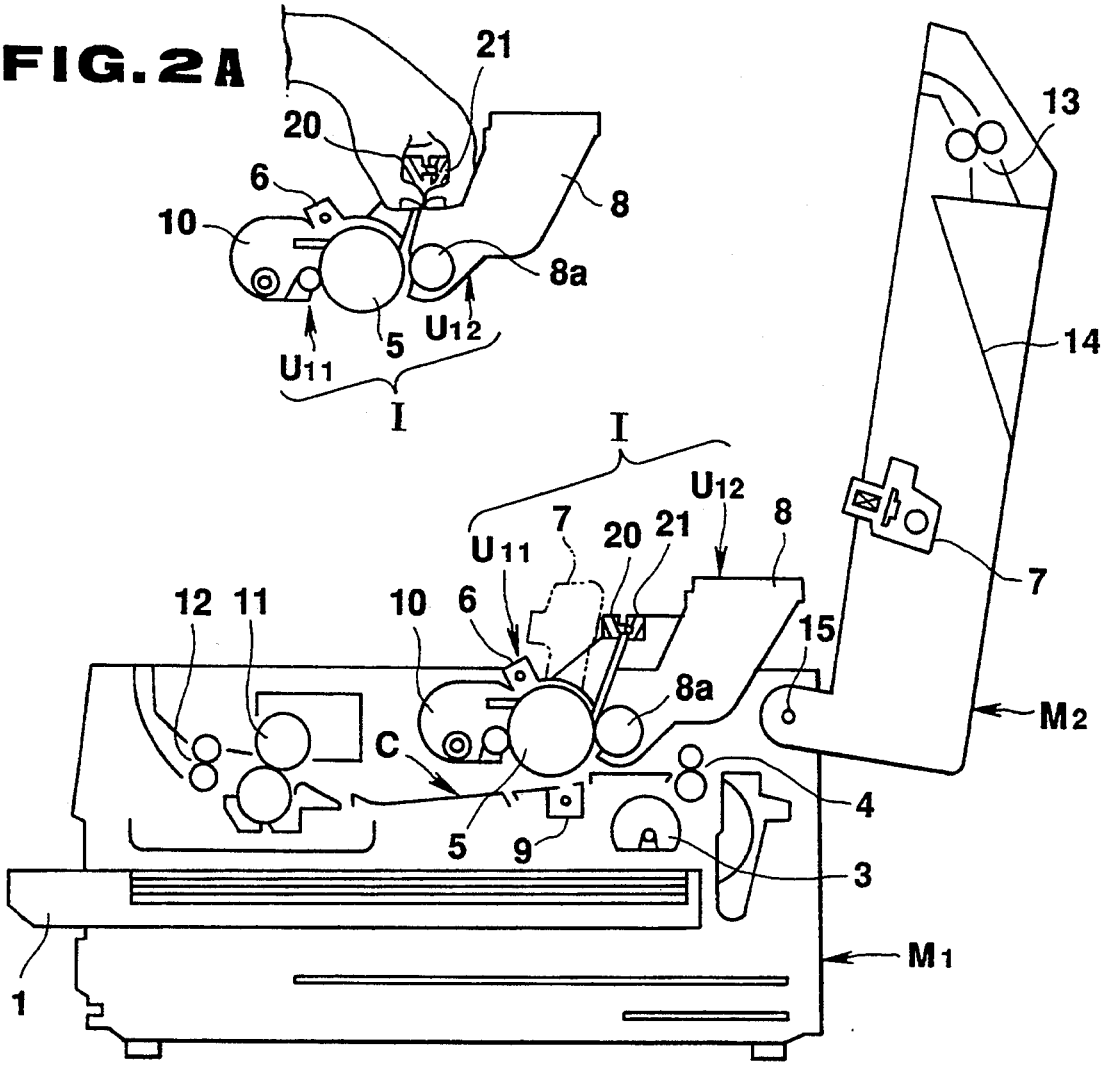
FIG. 2
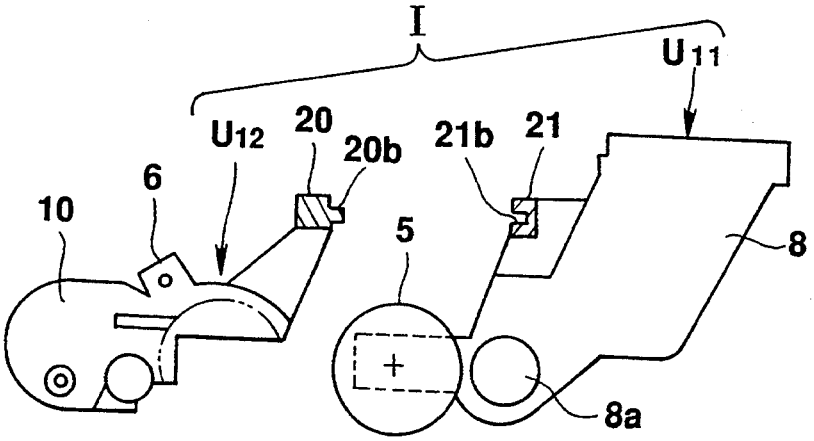
FIG. 3

IMAGE FORMING ASSEMBLY AND IMAGE RECORDING APPARATUS HAVING SEPARABLE IMAGE FORMATION UNITS WITH COMPLEMENTARY HANDLES THEREFOR

BACKGROUND OF THE INVENTION

1. Field of the Invention

This invention relates to an image forming assembly, which is used as a component of an image forming apparatus such as an electrostatic (electrophotographic) printer, a photocopier, a facsimile apparatus or the like, and is removably fitted in a housing of the image forming apparatus at a predetermined position along a paper sheet feeding path within the housing and functions as a main portion thereof for forming an image on a paper sheet fed along the paper sheet feeding path, and relates to an image forming apparatus incorporating the same.

More particularly, this invention relates to an image forming assembly, which comprises a first unit including an image carrier and a second unit being independent of the first unit and including image formation relating means such as development means for taking part in an image formation on the image carrier, and an image formation apparatus incorporating the same.

2. Description of the Related Art

FIG. 4 schematically shows an interior construction of an electrophotographic printer as an example of a conventional image forming apparatus of the above described category.

A paper sheet feeding cassette 1 and an image forming assembly 2 are located at their respective predetermined positions in a housing of the above described printer. A paper sheet pick-up roller 3 for picking up a paper sheet one by one from the paper sheet feeding cassette 1 and waiting rollers 4 for forwarding the paper sheet coming from the paper sheet pick-up roller 3 to the image forming assembly 2 with predetermined timing are further mounted in the housing.

The image forming assembly 2 for forming a toner image on the paper sheet coming from the waiting rollers 4 includes a photosensitive drum 5 as an image carrier for carrying an electrostatic latent image, and further includes an electrically charging device 6, a latent image forming head 7, a developing device 8, a transferring device 9 and a cleaner 10, which are arranged around the photosensitive drum 5 in the above mentioned order in a predetermined direction of rotation of the photosensitive drum 5, and all of which are the image formation relating means. While the photosensitive drum 5 makes a full turn in the predetermined direction, the outer peripheral surface of the photosensitive drum 5 is charged with electricity by the electrically charging device 6 and an electrostatic latent image is formed on the electrically charged outer peripheral surface of the photosensitive drum 5 by the latent image forming head 7. Thereafter, the electrostatic latent image on the outer peripheral surface is developed by the developing device 8 to produce a toner image, then, the toner image is transferred by the transferring device 9 onto a paper sheet coming from the waiting rollers 4. Finally, the toner remaining on the outer peripheral surface is removed by the cleaner 10.

In the housing of the conventional printer, fixing rollers 11 for fixing the toner image onto the paper sheet coming from the assembly 2, conveyer rollers 12 for conveying the image carrying paper sheet from the fixing rollers 11 toward a stacking tray 14 disposed outside of the housing and discharging rollers 13 for discharging the image carrying paper sheet coming from the conveyer rollers 12 into the stacking tray 14.

In the housing of the above described conventional printer, a paper sheet feeding path C extends substantially and horizontally from the waiting rollers 4 to the fixing rollers 11, and passes through a narrow space between a lower end of the photosensitive drum 5 and the transfering device 9.

The housing of the conventional printer is constructed by a lower portion $M_1$ and an upper portion $M_2$ which is rotatably connected to the lower portion $M_1$ by means of hinges 15 disposed at one end of the upper portion $M_2$. In the above described conventional printer, the stacking tray 14, the discharging rollers 13 and the latent image forming head 7 of the image forming assembly 2 are attached to the upper portion $M_2$ so that they move with the upper portion $M_2$ as illustrated in FIG. 5.

Relating to the image forming assembly 2, most of the image formation relating means (excepting the latent image forming head 7 which is attached to the upper portion $M_2$ and the transferring device 9 which is attached to the lower portion $M_1$) such as the photosensitive drum 5, the electrically charging device 6, the developing device 8, and the cleaner 10 are constructed as one unit or two units. In FIGS. 4 and 5, the photosensitive drum 5, the electrically charging device 6 and the cleaner 10 construct a first unit $U_1$ provided with a handle 16, and the developing device 8 constructs a second unit $U_2$ provided with a handle 17.

After the upper portion $M_2$ is moved to its open position shown in FIG. 5, the one unit or two units can be removed upward from its predetermined position or their predetermined positions in the housing of the conventional printer along an imaginary line crossing the paper sheet feeding path C.

If most of the image formation relating means are constructed as one unit, a paper-jam, happened at a position in the paper sheet feeding path C which is near to the image forming assembly 2, can be readily cleared, because most of the image formation relating means can be removed from the housing of the printer at one time.

In a portable printer, such one unit is removed from the housing of the printer, thrown away and replaced with a new one whenever the photosensitive drum 5 is degraded or the toner in the developing device 8 is used up. Since the toner in the developing device 8 is normally used up before remarkable degradation of the photosensitive drum 5 occurs, the photosensitive drum 5, the electrically charging device 6 and the cleaner 10 all of which are contained in the removed unit are still usable.

Thus, if most of the image formation relating means are constructed as one unit, a running cost of the printer is high. Particularly, since the life of the photosensitive drum 5 has become by far longer than that of the developing device 8 in recent years, the high running cost of the printer is currently very remarkable.

If most of the image formation relating means are constructed as first and second units $U_1$, $U_2$ as shown in FIG. 4, only the second unit $U_2$ containing the developing device 8 can be replaced by a new one when the toner in the developing device 8 is used up, so that the first unit $U_1$ containing the photosensitive drum 5 can be used much longer until the photosensitive drum 5 is degraded regardless of the using up of the toner in the developing device 8.

In the latter case, however, a paper-jam, happened at a position in the paper sheet feeding path C which is near to the image forming assembly 2, can not be readily cleared because, as illustrated in FIG. 5, the first and second units $U_1$, $U_2$ should be separately moved away from the lower portion $M_1$ with being held separately the respective handles 16, 17 by a hand of an operator after the upper portion $M_2$ is moved away upward from the lower portion $M_1$ by rotating the former around the hinges 15 at its one end.

SUMMARY OF THE INVENTION

In view of the above described circumstances, it is therefore an object of the present invention to provide an image forming assembly, which is used as a component of an image forming apparatus having a paper sheet feeding path, is removably fitted in a housing of the image forming apparatus at a given position along the paper feeding path within the housing, functions as a main portion thereof for forming an image on a paper sheet fed along the paper feeding path, comprises a first unit having an image carrier and a second unit being independent of the first unit and having image formation relating means such as development means for taking part in an image formation on the image carrier, can be easily fitted to and removed from a predetermined position in the housing, and can be operated at a low running cost, and to provide an image forming apparatus incorporating such an image forming assembly.

In order to achieve the above described object, an image forming assembly of the present invention comprises a first unit having an image carrier and a second unit being independent of the first unit and having image formation relating means for taking part in an image formation on the image carrier, the first and second units being adjacent to each other within the housing is removably fitted in a housing of an image forming apparatus at a predetermined position along a paper feeding path arranged within the housing, functions as a main part for forming an image on a paper sheet fed in the paper sheet feeding path, and is provided with handling means for simultaneously operating the fist and second units to make them being simultaneously fitting to and simultaneously removable from their respective predetermined positions within the housing.

In order to achieve the above object, an image forming apparatus of the present invention comprises a housing in which a paper sheet feeding path is provided, an image forming assembly including a first unit having an image carrier and a second unit being independent of the first unit and having image formation relating means for taking part in an image formation on the image carrier is removably fitted at a predetermined position along the paper feeding path and operates as a main portion for forming an image on a paper sheet fed along the paper feeding path, the first and second units are adjacent to each other at the predetermined position within the housing and provided with handling means for simultaneously operating the first and second units to make them being simultaneously fitting to and simultaneously removable from their respective predetermined positions within the housing.

With an image forming assembly and an image forming apparatus characterized by being constructed as described above in accordance with this invention, the first and second units can be readily fitted to and removed from their respective predetermined positions within the housing because they are adjacent to each other along the paper feeding path at their respective predetermined positions to which they are removably fitted and they can be simultaneously operable to make them being simultaneously fitting to and simultaneously removable from their respective predetermined positions by means of the handling means. Additionally, since the first and second units can be replaced independently with new one, the image forming assembly and the image forming apparatus incorporating such an image forming assembly can be operated at significantly reduced running cost.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 2 is a side view of an image forming apparatus incorporating the image forming assembly of FIG. 1, showing a condition where both the first and second units are removably fitted at respective predetermined positions within a housing of the apparatus; same time, another condition where both units are removed from the predetermined position;

FIG. 2A is a side elevational view of the first and second units of the image forming assembly removed from the predetermined position;

FIG. 3 is a side view schematically showing a modification of the first and second units of the image forming assembly according to the embodiment of the present invention, in which both the first and second units being separated from each other;

FIGS. 5A and 5B are side elevational views of the image forming assembly units removed independently from the housing.

Now, one embodiment of the present invention and its modification will be described in greater detail by referring to FIGS. 1 through 3.

DETAILED DESCRIPTION OF THE PREFERRED EMBODIMENTS

Figure 1:
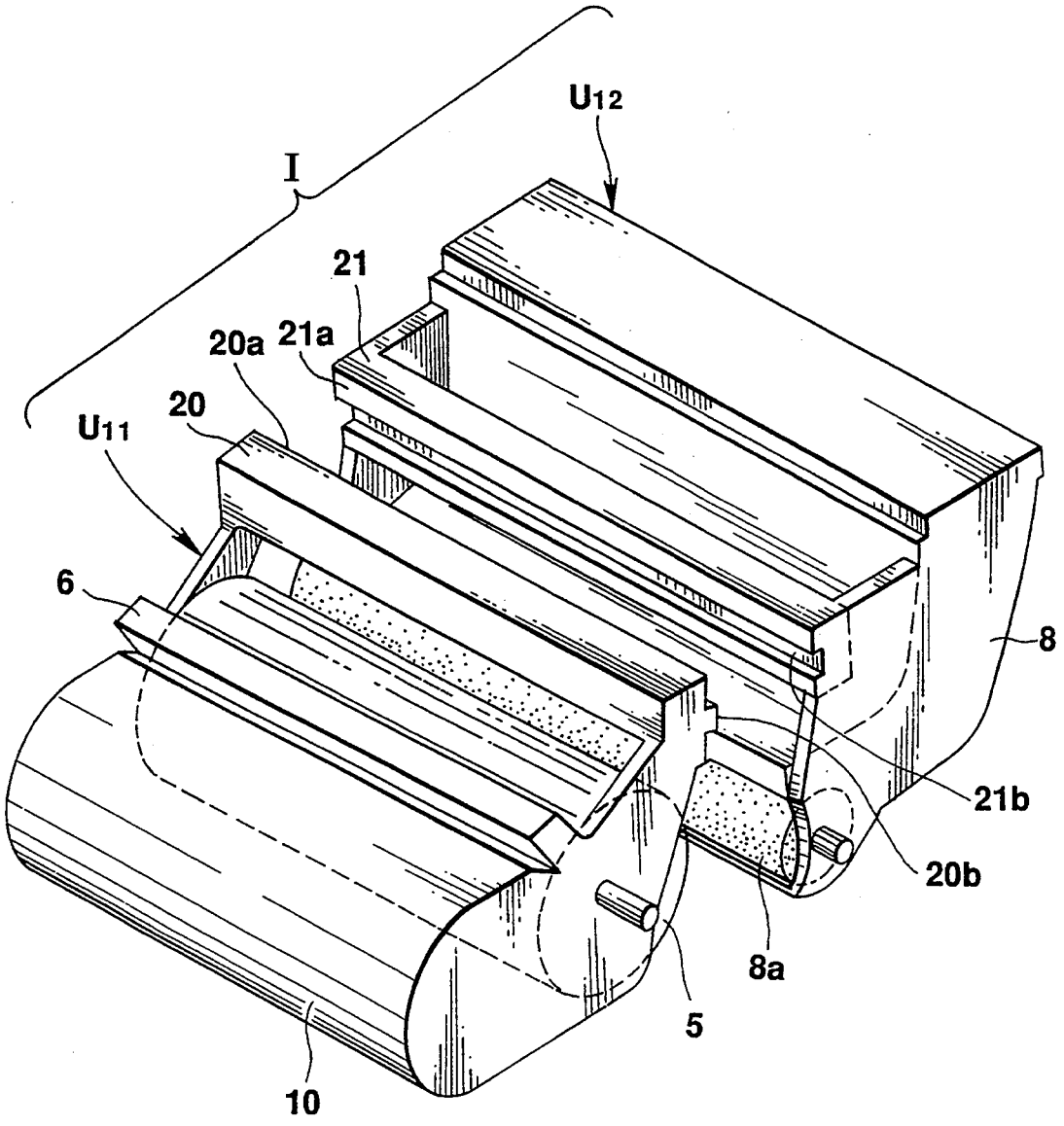
FIG. 1 is a perspective view showing first and second units of an image forming assembly according to an embodiment of the present invention in a condition that the first and second units are separated from each other.
Figure 4:
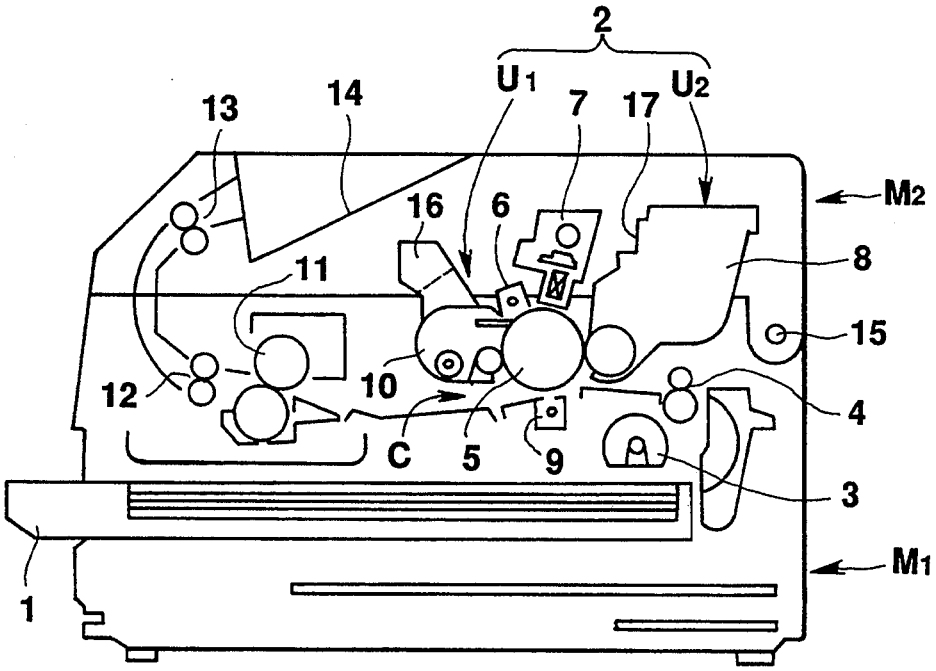
FIG. 4 (PRIOR ART)
FIG. 4 is a side view of an electrophotographic printer as a conventional image forming apparatus, schematically showing an interior construction of the printer.
Figure 5:
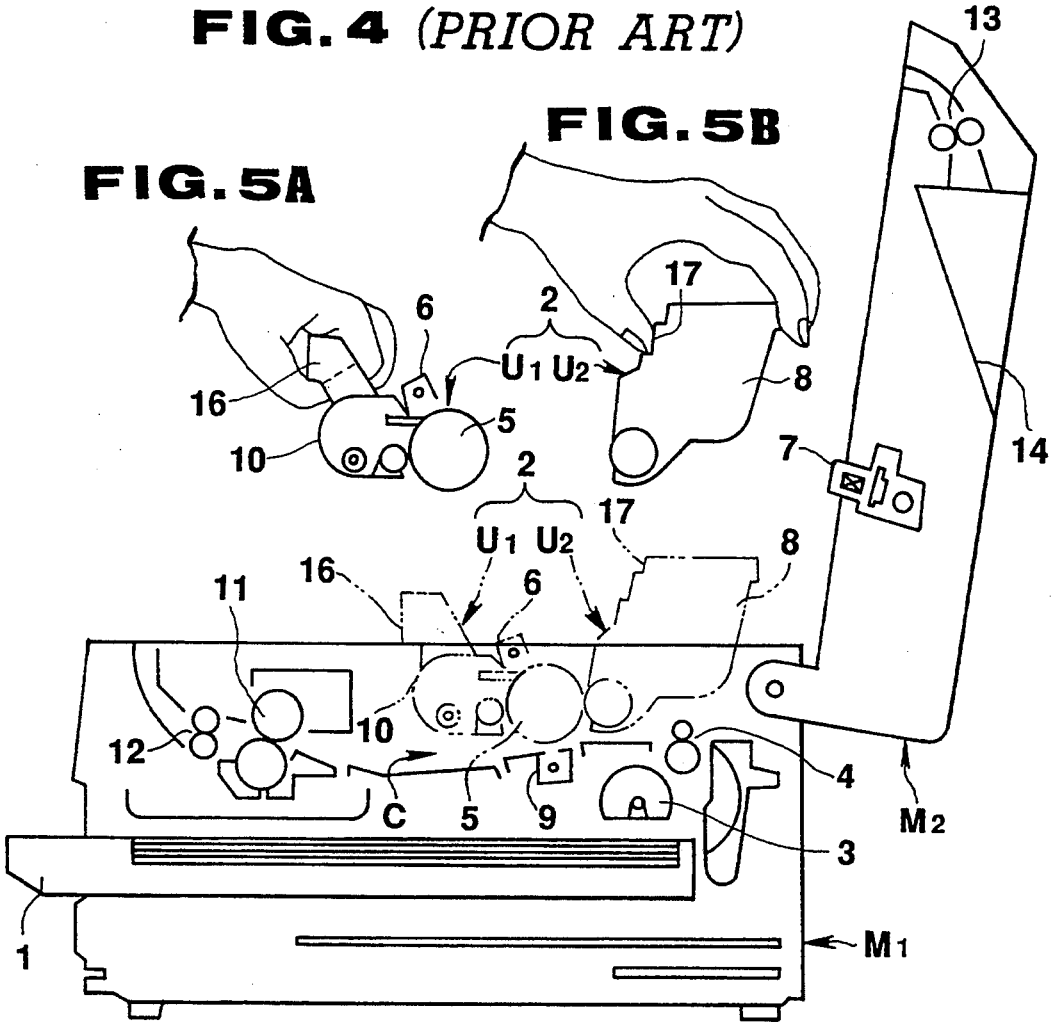
FIG. 5 (PRIOR ART)
FIG. 5 is a schematic side view of the image forming apparatus of FIG. 4, showing a condition where both first and second units of an image forming assembly of the apparatus are removably fitted at their respective predetermined positions within a housing of the apparatus.

FIG. 1 shows first and second units $U_{11}$, $U_{12}$ of an image forming assembly I according to an embodiment of this invention in a state that they are separated from each other, and FIG. 2 shows a state where both the first and second units $U_{11}$, $U_{12}$ of the image forming assembly I of FIG. 1 are removably fitted to their predetermined positions within the housing of the conventional image forming apparatus of FIGS. 4 and 5 in place of the first and second units $U_1$, $U_2$ of the conventional image forming assembly 2, and a state where both the units $U_{11}$, $U_{12}$ are simultaneously removed from the predetermined positions.

As in the case of the conventional first unit $U_1$ described earlier with reference to FIGS. 4 and 5, the first unit $U_{11}$ of the embodiment is constructed by supporting a photosensitive drum 5 as an image carrier, an electrically charging device 6 and a cleaner 10 on a common housing.

Similarly, like the conventional second unit $U_2$ described earlier with reference to FIGS. 4 and 5, the second unit $U_{12}$ of the embodiment is constructed by a developing device 8 that serves as one of image formation relating means.

As in particularly seen from FIG. 2, the first and second units $U_{11}$, $U_{12}$ are adjacent to each other when they are fitted at their respective predetermined positions within the housing of the image forming apparatus, and their housings are provided with handles 20, 21 which are adjacent to each other when the first and second units $U_{11}$, $U_{12}$ are fitted at their predetermined positions.

The handles 20, 21 are so arranged that they do not prevent a latent image forming head 7 attached to an upper portion $M_2$ of the housing of the image forming apparatus from coming to its predetermined position within the housing as indicated by a two-dots chain line in FIG. 2 when the upper portion $M_2$ of the housing of the image forming apparatus is located at its closed position. In other words, the handles 20, 21 of the first and second units $U_{11}$, $U_{12}$ do not interfere with formation of an electrostatic latent image on the photosensitive drum 5 by the latent image forming head 7 of the upper portion $M_2$ when the units are fitted at their predetermined positions within the housing of the image forming apparatus.

An engaging projection **20*b* and an engaging groove 21*b* are formed in opposing surfaces 20*a*, 21*a* of the handles 20, 21, as shown in FIG. 1, so that they engage with each other when the first and second units $U_{11}$, $U_{12}$ are adjacent to each other at their predetermined positions within the housing of the image forming apparatus and, therefore, the handles 20, 21 come close to each other with their opposing surfaces 20*a*, 21*a*** being opposed to each other.

With such an arrangement, both handles 20, 21 which are very close to each other can be held simultaneously by a single hand of an operator, as shown in the upper half of FIG. 2, and the first and second units $U_{11}$, $U_{12}$ can be removed simultaneously from their predetermined positions within the housing when the upper portion $M_2$ of the housing of the image forming apparatus is located at its open position. Moreover, the engagement between the engaging projection **20*b* and the engaging groove 21*b* in the opposing surfaces 20*a*, 21*a* of the handles 20, 21 causes the handles 20, 21 held by a single hand of the operator to be prevented from any relative movement so that the holding of the handles 20, 21** by a single hand becomes easy.

The first and second units $U_{11}$, $U_{12}$, the handles 20, 21 of which are held simultaneously by a single hand of the operator, can be removed easily and simultaneously from their respective predetermined positions by pulling upward them along an imaginary line that crosses the paper sheet feeding path C.

If any one part included in either the first unit $U_{11}$ or the second unit $U_{12}$ is degraded, damaged or used up and the first unit $U_{11}$ or the second unit $U_{12}$ need to be replaced with new one, both the first and second units $U_{11}$, $U_{12}$ are removed simultaneously from their predetermined positions within the housing of the image forming apparatus and then are separated from each other and either the first or the second unit $U_{11}$ or $U_{12}$ needed to be replaced with a new one is replaced with a new one.

In the above described embodiment, the strength of the engagement of the engaging projection **20*b* to the engaging groove 21*b* can be increased by forming at least the handles 20, 21 of the first and second units $U_{11}$, $U_{12}$ with a synthetic resin material having a certain degree of elasticity and by setting the sizes of a projecting end portion of the engaging projection 20*b* of the handle 20 slightly larger than the sizes of an opening of the engaging groove 21*b* of the handle 21. With such an arrangement, the handles 20, 21** held by a single hand of the operator can be prevented firmly from any relative movement so that they can be more easily held by a single hand of the operator.

The relative positioning of the first and second units $U_{11}$, $U_{12}$ at their predetermined positions within the housing of the image forming apparatus (e.g., the positioning of the outer peripheral surface of the photosensitive drum 5 of the first unit $U_{11}$ relative to that of a development sleeve **8*a* of the developing device 8 of the second unit $U_{12}$) can be realized by the engagement of the engaging projection 20*b* of the handle 20 with the engaging groove 21*b* of the handle 21**. Alternatively, if the accuracy of the sizes in the engagement is low, the relative positioning of the first and second units $U_{11}$, $U_{12}$ can be realized by providing at the predetermined positions within the housing of the image forming apparatus with well known positioning means.

The engaging projection **20*b* of the handle 20 of the first unit $U_{11}$ and the engaging groove 21*b* of the handle 21 of the second unit $U_{12}$ extend over the entire longitudinal length of the respective opposing surfaces 20*a*, 21*a* in the above described embodiment. However, they may be divided into a plurality of projections and a same number of grooves and arranged on their corresponding opposing surfaces 20*a*, 21*a*** to be separated from any adjacent ones.

Separably fastening means, as a combination of the engaging projection **20*b* and the engaging groove 21*b*, for the handle 20 of the first unit $U_{11}$ and the handle 21 of the second unit $U_{12}$ can be replaced by a pair of magnets that attract each other and are disposed on the respective handles 20, 21**.

It should be noted, however, that such fastening means are not absolutely necessary for the purpose of the present invention. The basic requirement for the handle 20 of the first unit $U_{11}$ and the handle 21 of the second unit $U_{12}$ is that they can he held by a single hand of the operator when the first and second units $U_{11}$, $U_{12}$ are fitted at their respective predetermined positions within the housing of the image forming apparatus and therefore the handles 20, 21 are adjacent to each other.

According to an aspect of the present invention, the first unit $U_{11}$ of the image forming assembly is required to support at least the photosensitive drum 5 as an image carrier, while the second unit $U_{12}$ is required to support at least one of the electrically charging device 6, the latent image forming head 7, the developing device 8, the transferring device 9 and the cleaner 10 all of which serve as the image formation relating means.

For example, as shown in FIG. 3, the first unit $U_{11}$ may be constructed by combining the photosensitive drum 5 as an image carrier with the developing device 8, while the second unit $U_{12}$ may be constructed by the electrically charging device 6 and the cleaner 10 both of which belong to the image formation relating means.

Alternatively, in a well known image forming assembly that operates without the cleaner 10, however, the first unit $U_{11}$ may be constructed by the photosensitive drum 5 as an image carrier and the electrically charging device 6, while the second unit $U_{12}$ may be constructed by the developing device 8 as one of the image formation relating means.

Further, according to an aspect of the invention, the housing of the image forming apparatus may not be divided into upper and lower portions, and the image forming assembly I can be fitted sidewardly to and removed sidewardly from their predetermined positions within the housing through a side opening of the housing by opening a door disposed at the side opening of the housing. In this case, the handles 20, 21 should be arranged at respective side surfaces of the housings of the first and second units $U_{11}$, $U_{12}$ in such a manner that they may be simultaneously held by a single hand of the operator.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming assembly, removably mounted in a housing of an image recording apparatus, the housing containing a paper feeding path, said image forming assembly being adapted to be installed in a predetermined position along the paper feeding path and to form an image on a paper sheet fed along the paper feeding path, and comprising:

a first unit provided with a first handle and including image carrier means; and a second unit provided with a second handle and including image formation relating means, said image formation relating means being adapted to cooperate with said image carrier means of said first unit to perform an image forming operation to form an image on the paper sheet fed along the paper feeding path;

wherein said first unit and said second unit are mounted adjacent to each other in the predetermined position along the paper feeding path, thereby allowing said image carrier means of said first unit and said image formation relating means of said second unit to cooperate with each other to perform the image forming operation, and said first and second units are physically separatable from each other when said first and second units are removed from the predetermined position along the paper feeding path; and wherein said first handle of said first unit and said second handle of said second unit form a handle unit to be gripped with a single hand by an operator, when said first unit and said second unit are mounted in the predetermined position along the paper feeding path, whereby the operator is allowed to simultaneously mount said first and second units in said predetermined position and to remove said first and second units therefrom by gripping said handle with a single hand.

2. An image forming assembly according to claim 1, wherein said image formation relating means included in said second unit is an image developing means for developing a latent image formed on a surface of said image carrier means.

3. An image forming assembly according to claim 1, wherein said image formation relating means included in said second unit is a cleaning means for cleaning a surface of said image carrier means.

4. An image forming assembly according to claim 1, wherein said first and second units are moved close to or away from the paper feeding path along an imaginary line crossing a face of the paper feeding path when said first and second units are mounted in or removed from the predetermined position within the housing of the image recording apparatus.

5. An image forming assembly according to claim 4, wherein the imaginary line, along which said first and second units are moved close to or away from the paper feeding path, is perpendicular to the face of the paper feeding path.

6. An image forming assembly according to claim 1, wherein said first and second handles are located in a position that they do not interfere with formation of an image on the image carrier means of said first unit while said first and second units are mounted in the predetermined position within the housing of the image recording apparatus.

7. An image forming assembly according to claim 1, wherein said first and second handles include fastening means for removably fastening said first and second handles together when said first and second units are mounted in the predetermined position within the housing of the image recording apparatus.

8. An image forming assembly according to claim 7, wherein said fastening means has a positioning function for determining relative positions of said first and second units within the housing of the image recording apparatus.

9. An image forming assembly according to claim 7, wherein said fastening means includes an engaging recess and an engaging projection respectively formed in said first and second units, and releasably engaging the units with each other when said first and second units are mounted in the predetermined position within the housing of the image recording apparatus.

10. An image forming assembly according to claim 1 wherein said first unit includes a developing device and said second unit includes a cleaner.

11. An image forming assembly according to claim 1 wherein said first unit includes a photosensitive drum and said second unit includes at least one of an electrically charging device, a latent image forming head, a developing device, a transfer device and a cleaner.

12. An image recording apparatus comprising:

a housing having a paper feeding path and an image forming assembly removably mounted in a predetermined position along the paper feeding path to form an image on a paper sheet fed along the paper feeding path;

said assembly including a first unit provided with a first handle and including image carrier means, and a second unit provided with a second handle and including image formation relating means, said image formation relating means being adapted to cooperate with said image carrier means of said first unit to perform an image forming operation to form an image on the paper sheet fed along the paper feeding path;

wherein said first unit and said second unit are mounted adjacent to each other in the predetermined position along the paper feeding path, thereby allowing said image carrier means of said first unit and said image formation relating means of said second unit to cooperate with each other to perform the image forming operation, and said first and second units are physically separatable from each other when said first and second units are removed from the predetermined position along the paper feeding path; and wherein said first handle of said first unit and said second handle of said second unit form a handle unit to be gripped with a single hand by an operator, when said first unit and said second unit are mounted in the predetermined position along the paper feeding path, whereby the operator is allowed to simultaneously mount said first and second units in said predetermined position and to remove said first and second units therefrom by gripping said handle unit with a single hand.

13. An image recording apparatus according to claim 12, wherein said image formation relating means included in said second unit is an image developing means for developing a latent image formed on a surface of said image carrier means.

14. An image recording apparatus according to claim 12, wherein said image formation relating means included in said second unit is a cleaning means for cleaning a surface of said image carrier means.

15. An image recording apparatus according to claim 12, wherein said first and second units are moved close to or away from the paper feeding path along an imaginary line crossing a fast of the paper feeding path when said first and second units are mounted in or removed from said predetermined position within the housing of said image recording apparatus.

16. An image recording apparatus according to claim 14, wherein the imaginary line, along which said first and second units are moved close to or away from the paper feeding path, is perpendicular to the face of the paper feeding path.

17. An image recording apparatus according to claim 12, wherein said first and second handles are located in a position that they do not interfere with formation of an image on said image carrier means of said first unit while said first and second units are fitted in the predetermined position within the housing of the image recording apparatus.

18. An image recording apparatus according to claim 12, wherein said first and second handles include fastening means for removably fastening said first and second handles together when said first and second units are mounted in the predetermined position within the housing of the image recording apparatus.

19. An image recording apparatus according to claim 18, wherein said fastening means has a positioning function for determining relative positions of said first and second units within the housing of the image recording apparatus.

20. An image recording apparatus according to claim 18, wherein said fastening means includes an engaging recess and an engaging projection respectively formed in said first and second units, and releasably engaging the units with each other when said first and second units are mounted in the predetermined position within the housing of the image recording apparatus.

21. An image recording apparatus according to claim 12 wherein said first unit includes a developing device and said second unit includes a cleaner.

22. An image recording apparatus according to claim 12 wherein said first unit includes a photosensitive drum and said second unit includes at least one of an electrically charging device, a latent image forming head, a developing device, a transfer device and a cleaner.

* * * * *